United States Patent [19]

Ramsay

[11] 4,213,469

[45] Jul. 22, 1980

[54] SMOKER'S PIPE HAVING A HOLLOW PIPE BODY FORMED FROM METALLIC HALF SECTIONS

[76] Inventor: George S. Ramsay, 1009 Aragon Ave., Saint Augustine Shores, Fla. 32084

[21] Appl. No.: 18,769

[22] Filed: Mar. 8, 1979

[51] Int. Cl.[3] ..... A24F 5/01

[52] U.S. Cl. ..... 131/199; 131/220; 131/222; 131/226

[58] Field of Search ..... 131/220, 227, 199, 226, 131/230, 224, 223, 194, 196

[56] References Cited

U.S. PATENT DOCUMENTS

| | | | |
|---|---|---|---|
| 553,074 | 1/1896 | Riecker | 131/223 |
| 1,461,126 | 7/1923 | Lasure | 131/220 X |
| 1,627,416 | 5/1927 | Schuman | 131/199 |
| 1,756,695 | 4/1930 | Lucas | 131/220 X |

*Primary Examiner*—Stephen C. Pellegrino
*Attorney, Agent, or Firm*—Watson, Cole, Grindle & Watson

[57] ABSTRACT

A smoker's pipe includes a hollow pipe body configured to define a hollow bowl seat portin and a hollow stem portion, a thin metal support bowl positioned within the hollow bowl seat portion, a clay tobacco-burning bowl positioned within the thin metal support bowl, a protecting ring for preventing chipping of the lip of the clay bowl, and a mouthpiece connected to the hollow stem portion of the pipe body opposite the end thereof connected to the hollow bowl seat portion. The pipe body is fabricated by soldering together two mirror-image half sections which have themselves been stamp-formed around wooden models. The mouthpiece can advantageously include a valve for preventing moisture (saliva) from passing through the mouthpiece back into the pipe body.

11 Claims, 8 Drawing Figures

SMOKER'S PIPE HAVING A HOLLOW PIPE BODY FORMED FROM METALLIC HALF SECTIONS

BACKGROUND OF THE INVENTION

Throughout the ages pipe smoking has been a popular pastime in almost all the various cultures that have existed throughout the world (as well as a social custom in some cultures), and in modern societies pipe smoking is of ever increasing popularity—not only because it provides enjoyment for the smoker himself, but also because the smoker knows that it is considered to be pleasant by the people in his immediate company as well, i.e., because most currently available tobaccos are formulated to generate pleasant and lingering aromas when lit.

Modern pipes used for the smoking of pipe tobaccos are made from many different materials, both man-made and naturally existing, and are available in a wide variety of shapes and sizes. Such pipes are not only purchased by the smoker for his own use, but are bought by gift-givers as well, due to the fact that most pipe smokers like to have a half dozen or so pipes to choose from when smoking, e.g., because it is a common practice to sequentially employ a new pipe for each new refill of tobacco to be smoked.

It is most desirable that tobacco-burning pipes be relatively lightweight, reliably constructed and cool to the touch, even when tobacco is burned therein for many hours. In addition, it is also desirable that the pipes be constructed so as to prevent moisture (saliva) from entering into the interior of the pipe body from the smoker's mouth. This is because such moisture not only wets the burning tobacco and thereby interferes with its proper burning, but it will obstruct the proper functioning of the pipe itself, including the functioning of the filter located within the pipe body.

The present inventive pipe is constructed so as to be lightweight, trouble free, cool smoking and dry. It is also constructed to provide the utmost degree of reliability in tar and nicotine filtration.

SUMMARY OF THE INVENTION

According to the present invention, the smoker's pipe comprises a hollow metallic pipe body to which are attached various elements which fit in and on the hollow bowl seat portion of the pipe body and the hollow stem portion. The metallic pipe body is fabricated by adhering together two half sections which have themselves been stamped formed around wooden forming molds.

More specifically, the smoker's pipe includes a pipe body formed of two connected metallic body half sections which are configured together to define a hollow bowl seat portion and a hollow stem portion; a thin metal bowl means which is positioned within the hollow bowl seat portion of the pipe body, the thin metal bowl means having a hole in its side so as to face the hollow stem portion of the pipe body; a clay bowl means for containing and burning of tobacco which is positioned within the thin metal support bowl means, the clay bowl means having a threaded hole in its side so as to be aligned with the hole in the side of the thin metal support bowl means; a protecting ring means which is positioned over the lip of the clay bowl means and is attached to the hollow seat portion of the pipe body; a guide funnel means which is positioned to extend through the hole in the side of the thin metal support bowl means and threadably engage with the threaded hole in the side of the clay bowl means, such that the enlarged head portion of the guide funnel means will face the hollow stem portion of the pipe body; and a mouthpiece which is attached to the end of the hollow stem portion of the pipe body opposite the end connected to the hollow bowl seat portion. A filter element is advantageously positioned within the hollow stem portion of the pipe body so as to filter, i.e. remove the tar and nicotine, from the smoke passing through the hollow stem portion (the smoke of course being generated by the tobacco burning within the clay bowl, than passing through the guide funnel, the pipe body stem portion, and the mouthpiece, and ultimately into the smoker's mouth).

According to another aspect of the invention, a special pipe mouthpiece includes not only a central smoke passageway, but also an enlarged exit chamber to which the passageway communicates, to allow for smoke to pass from within the pipe body stem portion, through the mouthpiece passageway and into both the exit chamber and the smoker's mouth when the smoker inhales, but prevent moisture (saliva) from returning from the smoker's mouth and/or the exit chamber into the mouthpiece passageway and ultimately into the hollow pipe body stem portion upon completion of the smoke inhalation process. Although the concept of preventing saliva from entering a pipe stem and from ultimately coming in contact with tobacco in the pipe bowl is well known as shown, for example, in U.S. Pat. Nos. 497,351; 553,074; 1,037,780; 1,547,042; 1,801,428; and 2,202,342, the valve device of the present invention is easily inserted in position inside of the exit chamber of the mouthpiece, it is easily removed and replaced, and it is quite inexpensive.

DETAILED DESCRIPTION OF THE PREFERRED EMBODIMENTS

Figure 1:
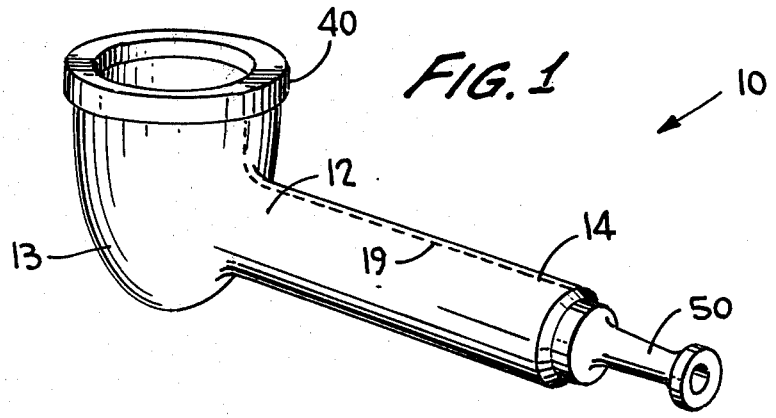
FIG. 1 shows a perspective view of a smoker's pipe in accordance with the present invention.

As can be seen from FIG. 1, the outwardly observable features of the pipe 10 of the invention include a pipe body which is shaped to define a bowl seat portion 13 and a stem portion 14, a bowl protective ring means 40 and a mouthpiece 50. As is conventional, the mouthpiece 50 is connected to the stem portion 14 at the end opposite the end of the stem connected to bowl seat portion 13.

Figure 2:
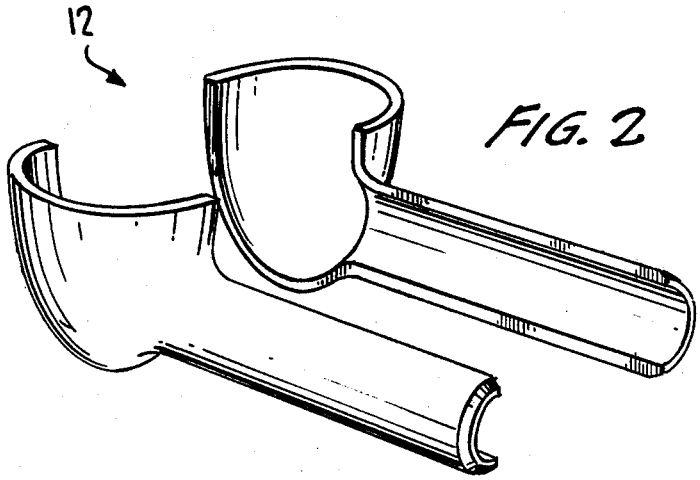
FIG. 2 shows a perspective view of the two half sections of the pipe body prior to attachment together.
Figure 3:
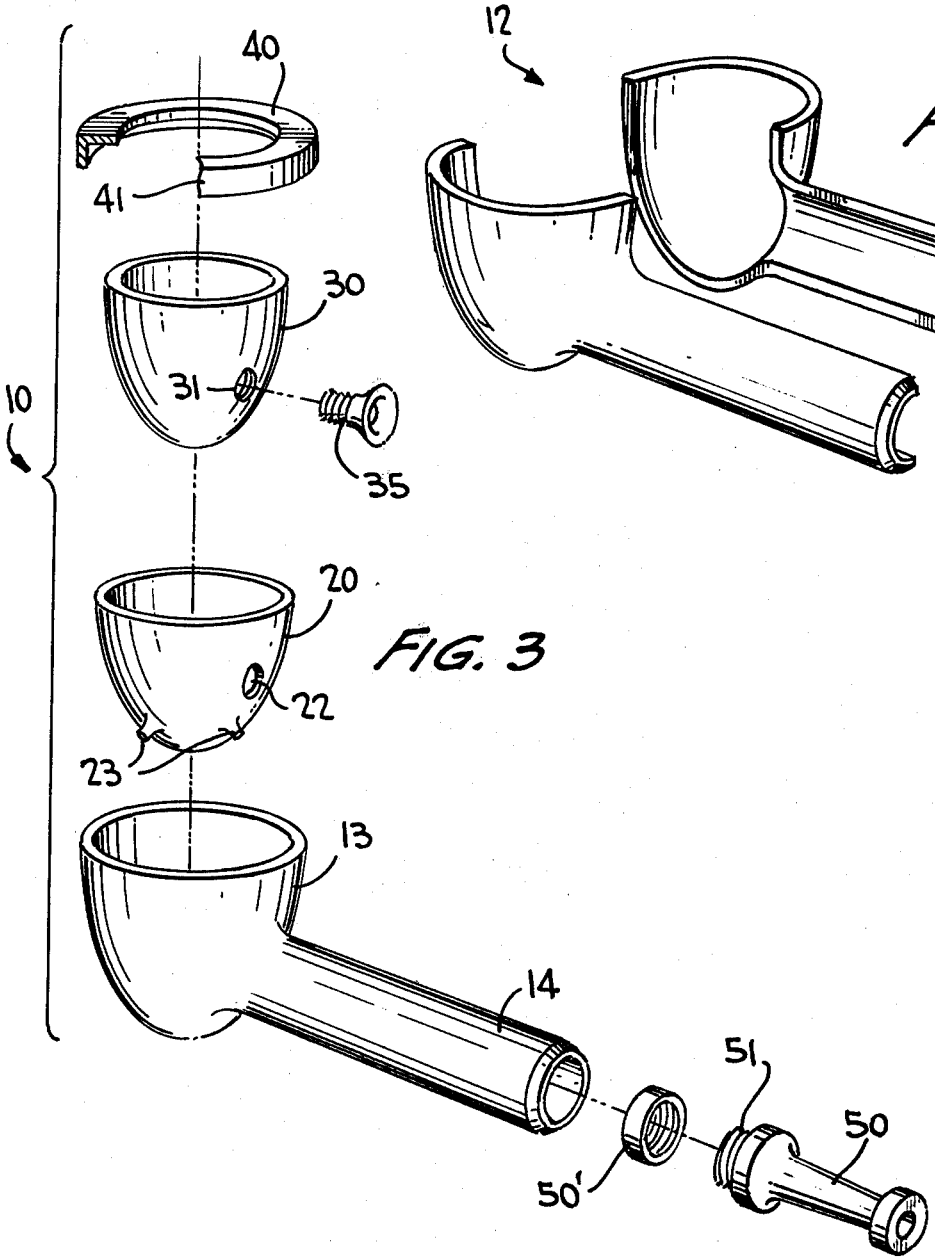
FIG. 3 shows an exploded perspective view of the various elements which are fitted together in order to construct the inventive pipe.

According to the present invention, the pipe body 12 is made of metal and is fabricated by fixedly attaching together two mirror-image half sections of the pipe body which have each been formed by stamping a thin metal sheet around suitable forming molds (see FIG. 2, as well as dashed solder line 19 in FIG. 1). Such forming molds (not shown) are themselves produced by first fashioning a model of the pipe in the described shape in wood and then dividing the wooden model vertically in half. Appropriately dimensioned thin metal sheets, such as aluminum sheets of, say, gauge 25 or gauge 020, are then placed in contact with the forming molds and are pressed therearound in conventional fashion such that the pipe body half sections are formed. The attaching together of the two half sections can be accomplished by use of conventional techniques, e.g., by soldering, gluing, etc.

Figure 4:
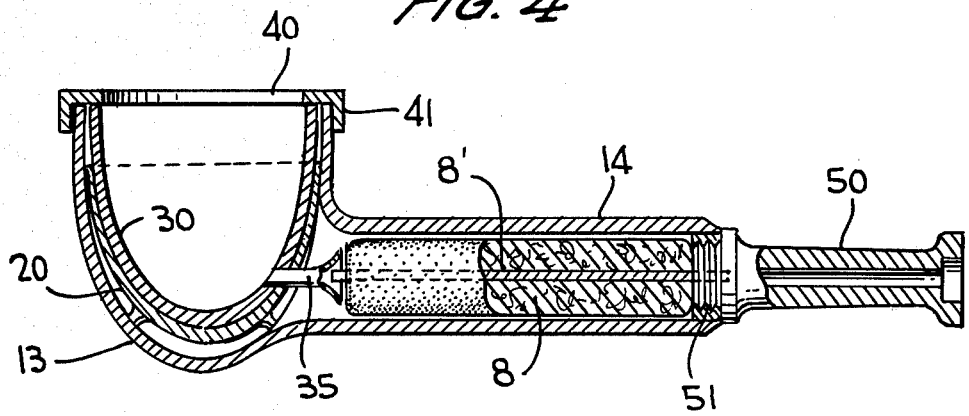
FIG. 4 shows a cross-sectional side view of the inventive pipe taken along a vertical plane through the middle of the pipe body.

Once the pipe body has itself been fabricated, the remainder of the elements, both internal and external, are attached thereto (or placed therein) in order to construct the pipe of the invention. In this regard, a thin metal support bowl means 20 is first placed inside of the hollow bowl seat portion 13, the thin metal support bowl means 20 including feet 23 for support thereof on the internal floor (not shown) of the bowl seat portion 13, as well as a hole 22 in its side so as to allow a smoke guide funnel means 35 to extend therethrough (as will be presently discussed). The thin metal support bowl means 20 is used to support a clay bowl means 30, which means 30 is itself then snugly fitted inside of the bowl means 20, one suitable type of bowl being commonly known as a Meerschaum bowl, which in fact is the container in which the tobacco to be smoked is ultimately placed and burned. Bowl means 30 includes a threaded hole 31 in its side which, when the bowl means 30 is properly positioned within the supporting bowl means 20 inside of bowl seat portion 13, is aligned with hole 22 in the thin bowl 20, such that the threaded stem portion of a hollow metal guide funnel means 35 can then be fitted through hole 22, via access from stem portion 14, and then threadingly attached to the side of the clay bowl means 30. The large end portion of guide funnel means 35, when bowls 20 and 30 are properly positioned, will face towards the mouthpiece 50 as is shown in FIG. 4. A metal protecting ring means 40 is thereafter positioned over the top of the clay bowl means 30 to help prevent chipping or cracking of the clay in the event the pipe is dropped, subjected to mild abuse, or merely tapped against a firm surface, i.e., when removing tobacco or ashes from inside the clay bowl 30. The skirt portion 41 of ring means 40 is of appropriate diameter and length to overlap and snugly encompass the top portion of bowl seat portion 13 of the pipe body 12. The skirt portion 41 is frictionally secured to the top of bowl seat portion 13. The metal protecting ring means can optionally be magnetized at, for example, two opposing locations so that a thin, round, perforated metal cover (not shown) can be removably attached thereto, such a metal cover, when used, acting to prevent ashes from inadvertently falling out of clay bowl 30.

Within the open end of stem portion 14 is attached (e.g., by soldering) a ring member 50' which has internal threads such that after attachment to stem portion 14, the mouthpiece 50 can be threadingly affixed therewithin. For this purpose mouthpiece 50 has a threaded end 51 which is cooperable with the threads within ring member 50'. Prior to positioning of mouthpiece 50 inside of ring member 50' the stem portion 14 is fitted with a medicated paper filter element 8, which generally takes up the entire space within the stem portion 14. Indeed, as is shown in FIG. 4, a central wire 8' extending through the filter element 8 will extend at one end into the hollow portion of the large end portion of threaded end 51. In this way, any tobacco which gets into the smoke path can be easily removed.

Figure 5:
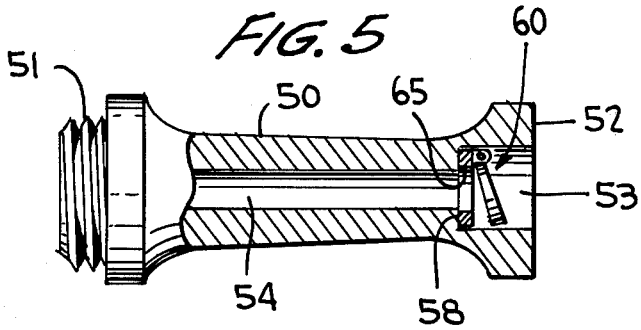
FIG. 5 shows an enlarged cross-sectional side view of the pipe mouthpiece in accordance with one embodiment of the invention, with certain features shown in exaggerated fashion.
Figure 6:
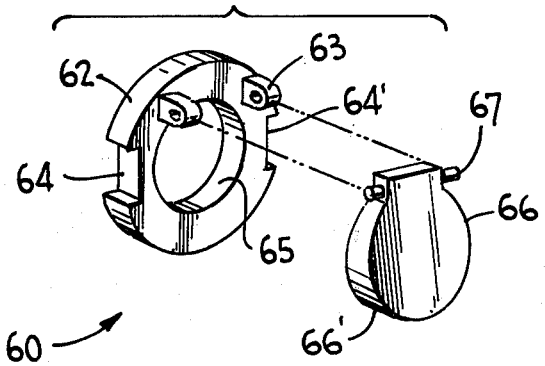
FIG. 6 shows an exploded and enlarged perspective view of the cooperating parts of the valve device positioned in the pipe mouthpiece of FIG. 3.
Figure 7:
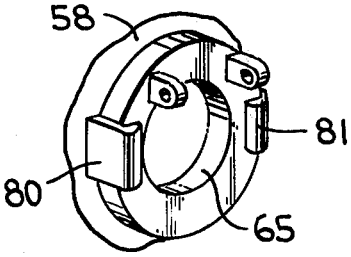
FIG. 7 shows a perspective view of the back plate of the FIG. 6 device in its mounted position within the pipe mouthpiece.

FIG. 5 schematically depicts a mouthpiece 50 according to one embodiment of the present invention. It can be seen that this mouthpiece not only includes the standard central smoke passageway 54 and funnel-like end portion 52, but it also includes an enlarged exit chamber 53 at the outlet portion of passageway 54 in which is mounted a valve 60. As can be seen from FIG. 6, valve 60 includes a back plate 62, which is of a sufficient size to cover the passageway outlet, has an opening 65 in the central portion thereof (shown as a circular opening, although any suitable shape could be used depending on the cross-sectional shape of passageway 54), and a correspondingly shaped trap door 66 which is pivotably attachable to back plate 62 by coacting hinge members 63 and 67. The back plate 62, which is shown as being generally disk shaped, but which can be square or rectangular in shape as well, includes indented portions 64, 64', which are located on opposite sides of the back plate 62 which are coactable with flanges 80, 81 projecting from the back wall 58 forming the chamber 53 (see FIGS. 5 and 7) to support the valve 60 in operating position. The trap door 60, which is not only of sufficient size to cover opening 65, but is lightweight enough to easily pivot around hinge 63, is shown as having an enlarged bottom portion 66', i.e., so as to lend a small amount of additional weight to the lower region of the trap door opposite the top portion connected to the hinge 63 and thus act to bias the trap door downwardly to be in a blocking relationship to the passage of fluids through the opening in back plate 62 and through passageway 54.

In use, the pipe 10, when employing the mouthpiece embodiment just described, operates as follows. Suitable pipe tobacco is placed within the clay (Meerschaum) bowl means 30 and lit, with the metal protecting ring means 40 preventing inadvertent chipping or cracking of the rim of the clay bowl means 30. As the smoker inserts mouthpiece 50 into his (or her) mouth and inhales, smoke is sucked from with the bowl 30 through guide funnel means 35, into stem portion 14, through filter element 8 in stem portion 14, down passageway 54, through the opening in back plate 62 and into exit chamber 53, and finally into the smoker's mouth. Smoke will freely enter exit chamber 54 because the vacuum created by the smoker's inhaling will cause the pivoting of trap door 66 of valve 60 in a counterclockwise direction (see FIG. 6) around pivot 63, 67 and away from contact with back plate 62. Once the smoker completes his inhalation, such that the air pressure in exit chamber 53 will tend to equalize with that in passageway 54, the trap door 66 will tend to swing in a clockwise direction, i.e., due to gravity acting on the lower portion thereof, and upon contact with the back plate 62, will close off the opening therein. Due to the closing of this opening, saliva from the smoker's mouth will then be prevented from entering passageway 54 and from there draining into the pipe stem 14. In this way, the internal portions of the pipe body will remain dry at all times.

Either the back plate 62 or support members 80, 81 can be advantageously made of a flexible material, e.g., flexible plastic, so that the back plate can not only be placed between support members 80, 81 with a snap action, but also be relatibely easily removed from therebetween. Trap door 66 can optionally include a weighted member attached to the bottom portion 66' to help bias the positioning thereof in a closed (covering) relationship to opening 65.

Alternative forms of pivotal mounting of the trap door 66 to the back plate 62 may be used and still be within the scope of the present invention, as are alternative forms of removably mounting of the back plate onto the back wall 58 of the chamber 53. For example, the back plate, instead of having opposed indented portions 64, 64' which coact with flanges 80, 81 of the back wall 58, may have opposed extending bars which can be grasped by pivotable hooks attached to the back wall.

Figure 8:
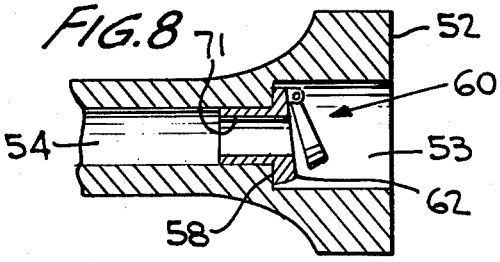
FIG. 8 shows a greatly enlarged cross-sectional side view of the exit end of an inventive pipe mouthpiece which includes an alternative embodiment of the mounted valve device.

In addition, as depicted in FIG. 8, the back plate member 62, which is shown as having a somewhat different shape from that of FIG. 5, may include a hollow extension portion 71 on the side thereof opposite the side to which the trap door is connected, which extension portion is shaped to correspond with the shape and dimensions of the passageway 54 such that the extension portion will sealingly fit within and against the wall of passageway 54 as the back plate 62 of the valve 60 is snapped into position against back wall 58 and between flanges 80, 81.

The inventive pipe, once constructed, can be conventionally treated so as to have an anodized finish, or alternately be enclosed within a leather sheathing, as is commonplace with today's more expensive pipes.

In a sample pipe in accordance with the present invention the dimensions of the various components can be as follows:

Diameter of bowl seat 13—1½ inches
Vertical height of bowl seat 13—1⅝ inches
Length of pipe from front of bowl seat 13 to exit end of mouthpiece 50—5 13/16 inches
Diameter of pipe stem portion 14—15/16 inch
Length of mouthpiece 50—1½ inches
Thickness of clay bowl 30—3/16 inch
Vertical dimension of back plate 62—3/16 inch
Horizontal dimension of back plate 62 (when rectangular)—4/16 inch
Length of extension portion 71 of back plate 62—¼ to ⅜ inch
Protrusion of wire 8' into guide funnel 35—¼ inch
Diameter of enlarged exit chamber as compared to passageway—⅛ inch wider
Depth of enlarged exit chamber—3/16 inch
Diameter of ring member 50'—11/16 inch While there has been shown and described what is considered to be some preferred embodiments of the present invention, it will be obvious to those skilled in the art that various changes and modifications may be made therein without departing from the invention as defined in the appended claims.

I claim:

1. A dry, cool smoking and lightweight smoker's pipe which includes a pipe body formed of two attached metallic body half sections which are configured to define a hollow bowl seat portion and a hollow stem portion connected thereto; a thin metal support bowl means positioned within said hollow bowl seat portion of said pipe body, said thin metal support bowl means having a hole in the side thereof facing said hollow stem portion of said pipe body, a clay bowl means positioned within said thin metal support bowl means, said clay bowl means having a threaded hole in the side thereof aligned with the hole in the side of the thin metal support bowl means; a protecting ring means positioned over the tip of said clay bowl and attached to said hollow bowl seat portion of said pipe body; a hollow funnel means extending through the hole in said thin metal bowl means and threadably connected with the threaded hole in said clay bowl means, an enlarged head portion thereof facing said hollow stem portion of said pipe body; and a mouthpiece attached to the end of said hollow stem portion of said pipe body opposite the end connected to said hollow bowl seat portion.

2. The pipe of claim 1, wherein the hollow stem portion of said pipe includes an internally threaded ring attached therewithin at the end opposite said hollow bowl seat portion, wherein said mouthpiece includes an externally threaded end portion, and wherein said externally threaded end portion of said mouthpiece is threadedly engaged with internal threads of said ring.

3. The pipe of claim 1, wherein said pipe body is composed of metal, and wherein said body half sections are soldered together.

4. The pipe of claim 1, wherein said pipe includes a filter element positioned inside of said hollow stem portion.

5. The pipe of claim 1, wherein said mouthpiece includes means forming a central passageway therethrough, wherein said passageway located in the portion of said mouthpiece opposite the portion connected to said hollow stem portion of said pipe body communicates with an enlarged exit chamber, and wherein a valve means is positioned in said exit chamber, said valve means being operable to allow for passage of air and smoke from inside of said hollow stem portion of said pipe body through said passageway in said mouthpiece and into a smoker's mouth, but prevent fluid flow in the opposite direction.

6. The pipe of claim 5, wherein said chamber is formed by wall means including a back wall in which said passageway opens into said exit chamber, and wherein said valve, which is of a size sufficient to cover said passageway opening, is removably mounted on said back wall.

7. The pipe of claim 6, wherein said valve includes a back plate with central opening therein, and a trap door pivotally hinged to one side of said back plate, said trap door being of a size sufficient to cover said central opening in said back plate.

8. The pipe of claim 6, wherein said back wall includes means for clamping said back plate of said valve against said back wall such that said central opening of said back plate is in register with the passageway opening into said chamber.

9. The pipe of claim 6, wherein said back plate of said valve includes hinge means on one side thereof positioned above said central opening, wherein said trap door is pivotally connected to said hinge means, and wherein said trap door is constructed to be heavier at the portion opposite the portion connected to said hinge means so as to be biased in a covering relationship with said central opening in said back plate.

10. The pipe of claim 9, wherein said back plate includes a hollow extension portion which extends away from said back plate in a direction opposite to the side to which said trap door is attached, said extension portion sealingly fitting within said passageway.

11. A method of constructing a dry, cool-smoking and lightweight smoker's pipe which comprises molding two mirror-image pipe body half sections which each define half of a hollow bowl seat portion and half of a hollow stem portion, fixedly adhering said body half portions together to construct said hollow pipe body, placing a thin metal support bowl having a hole in the side thereof in the hollow bowl seat portion of said pipe body such that a hole faces the hollow stem portion of said pipe, placing a clay bowl having a threaded hole in the side thereof in the thin metal support bowl such that the threaded hole is aligned with the hole in the side of said thin metal support bowl, extending the threaded end of a guide funnel through the hole in said thin metal support bowl and threadedly engaging the threaded end in the threaded hole in said clay bowl, placing a metal protector ring over the rim of said clay bowl and fixedly attaching the ring to the hollow bowl seat portion of said pipe body, and fixedly attaching a mouthpiece to the end of the hollow stem portion of said pipe body opposite said hollow bowl seat portion.

* * * * *